United States Patent [19]

Chambers et al.

[11] 4,072,595

[45] Feb. 7, 1978

[54] ANODE SEAL ASSEMBLY FOR ELECTROLYTIC CELLS

[75] Inventors: Richard F. Chambers, Athens; John J. Granade, Cleveland, both of Tenn.

[73] Assignee: Olin Corporation, New Haven, Conn.

[21] Appl. No.: 775,127

[22] Filed: Mar. 7, 1977

[51] Int. Cl.[2] ..... C25B 9/00; C25B 1/40

[52] U.S. Cl. ..... 204/219; 204/242; 204/250; 204/279

[58] Field of Search ..... 204/219–220, 204/250, 99, 279, 242

[56] References Cited

U.S. PATENT DOCUMENTS

| | | | |
|---|---|---|---|
| 3,455,810 | 7/1969 | Holm | 204/250 X |
| 3,511,766 | 5/1970 | Kisner et al. | 204/250 X |
| 3,743,592 | 7/1973 | Metcalff | 204/279 X |
| 3,919,071 | 11/1975 | Mose | 204/279 X |
| 3,968,022 | 7/1976 | Eng et al. | 204/279 |

*Primary Examiner*—John H. Mack
*Assistant Examiner*—D. R. Valentine
*Attorney, Agent, or Firm*—Bruce E. Burdick; Donald F. Clements; Thomas P. O'Day

[57] ABSTRACT

An annular rigid disc and elastomeric annular ring sealing assembly for electrolytic cells with adjustable anode posts. The seal assembly has extended life, less costly construction and easier replacement due to the reduced cross-sectional area of flexible sealing material exposed to the hostile environment of the electrolytic cell.

13 Claims, 4 Drawing Figures

ANODE SEAL ASSEMBLY FOR ELECTROLYTIC CELLS

This invention relates to electrolytic cells and more specifically to an electrode seal assembly for an electrolytic cell.

One conventional means of sealing between the cell top of a mercury cathode electrolytic cell and an adjustable anode inserted through the cell top is the use of a rubber cup-shaped lip, such as shown at reference number 3*a* of U.S. Pat. No. 3,140,191, assigned to the assignee of this application. U.S. Pat. No. 3,140,191 is herein incorporated by reference as if set forth at length. However, such a flexible rubber seal is susceptible to deterioration from the combined flexing action and wet chlorine environment characteristic of such cells when utilized for the electrolysis of brine, and must provide for substantial flexing to allow anode adjustment. Since the cell operates by the passage of large amounts of electricity therethrough, the cell must periodically be "shut-down" in order to replace worn out seals. It is desirable to lessen the number of such shut-downs by lengthening the life of the seal. Also, there is a continual need to lessen the cost of the seals.

These and other problems are solved by the apparatus of the present invention which provides a seal assembly for an electrolytic mercury cell having an adjustable anode post sleeve passing through an anode opening in a cell top, comprising: a rigid annular disc means of wet chlorine resistant material having an inner surface defining a grooved central opening conforming to the exterior of the anode post sleeve, for attachment to the cell top so as to occupy a major portion of the anode opening; connector means for sealingly attaching the disc to the cell top; and annular wet chlorine resistant elastomeric seal means, adapted to be held within the groove of the central opening of the disc, for continuously sealing between the disc and the anode post sleeve both while the anode is moving and while the anode is stationary.

Another aspect of the invention provides an electrolytic cell, comprising: a cell top having a surface defining an opening therethrough; a lower housing portion connected to the cell top; a vertically movable anode post sleeve passing through the cell top opening; an annular wet chlorine resistant rigid disc means, sealingly attached to the cell top for partially occupying a major portion of a space between the anode post and the surface defining the cell top opening; an annular wet chlorine resistant seal means, held by the disc means, for occupying the remaining minor portion of the space between the anode post and the surface defining the cell top opening.

Yet another aspect of the invention provides a method of extending the life of an annular cup-shaped anode post cell top flexible seal of an electrolytic mercury cell, which comprises the steps of:

a. disattaching the cup-shaped seal from the cell top;

b. installing an elastomeric wet chlorine resistant annular seal, of much less cross-sectional area than the cross-sectional area of the cup-shaped seal, within a rigid wet chlorine resistant annular disc; and c. attaching the disc to the cell top with the same attachment means previously used to attach the cup-shaped seal.

The objects and advantages of the invention will be more apparent upon review of the detailed description below when considered in conjunction with the following drawing, in which FIG. 1 is side cross section view of a typical mercury cathode electrolytic cell containing a preferred embodiment of the invention;

Figure 1:
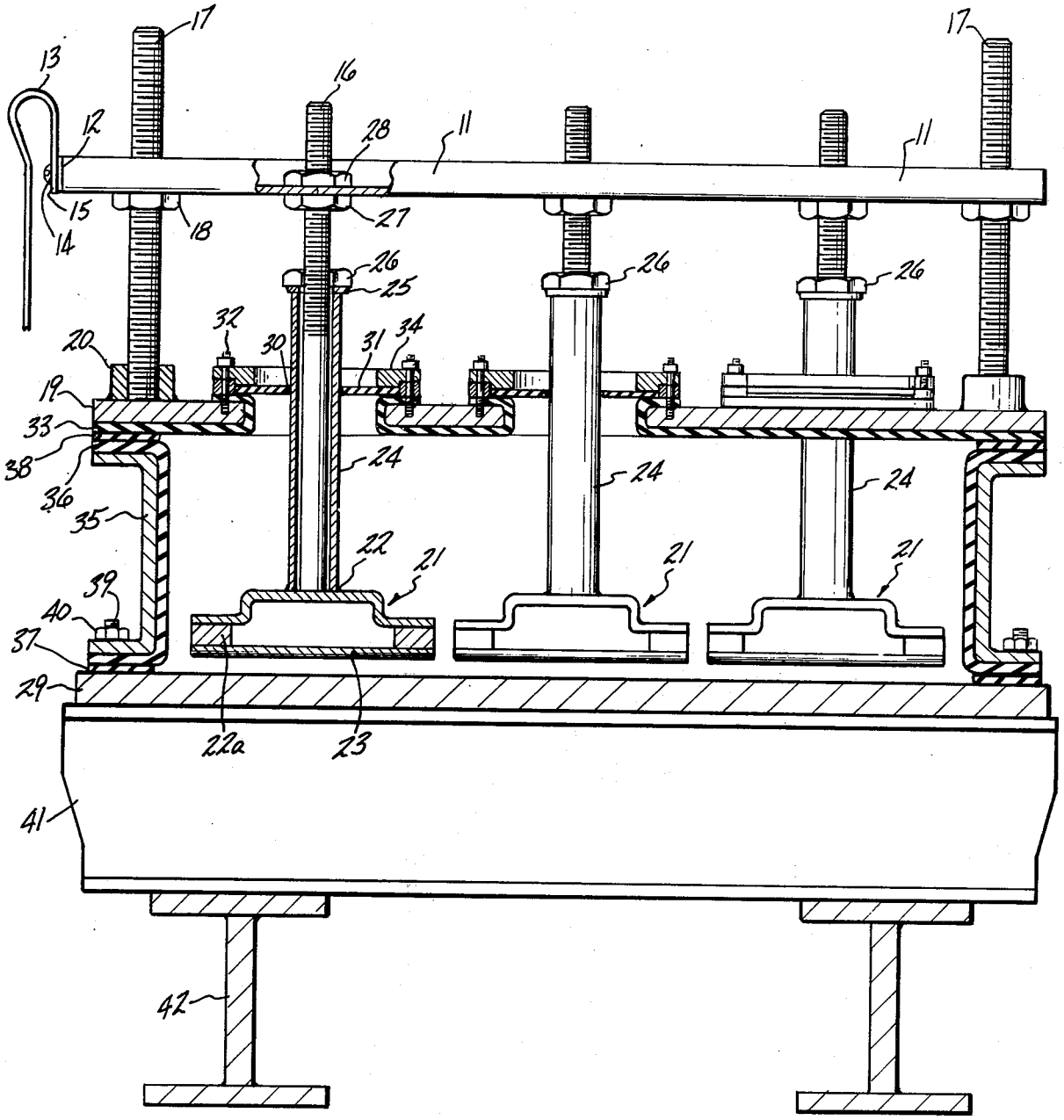

In FIG. 1, 11 is the combination copper bus feed bar and anode support. It is a copper channel closed by a copper plate 12 silver brazed at one end of the channel. To end plate 12 is connected a flexible copper connector 13 which in turn is connected to a bus bar (not shown) carrying the current to the anodes. Flexible connector 13 is connected to the plate 12 by bolt 14 at end 15. Channel 11 is drilled with holes at suitable spacings to receive anode lead-ins 16 and with holes near the end of the channel to receive jacking screws 17. The channel is supported on jacking screws 17 by adjusting nuts 18 by which the distance of the channel above the cell cover can be adjusted. The jacking screws are attached to cell cover 19 by screwing them into nuts 20 welded to the cell cover.

The anode may be adjusted by an automatic control such as described in U.S. Pat. Nos. 3,579,073, 3,873,430, 3,900,373, or 3,983,025. Lead-in 16 is attached at its lower end to anode assembly 21 by spin welding or other suitable connection means. Anode assembly 21 comprises distributor 22, and bandolier strip **22*a* and foraminous surface 23. The construction and structure of anode assembly 21 is preferably as described in U.S. Pat. No. 3,912,616, the disclosure of which is herein incorporated by reference as if set forth at length. Alternatively, anode assembly 21** could be a graphite anode assembly such as described in U.S. Pat. No. 3,140,191 or an integral cast titanium anode assembly such as shown in U.S. Pat. No. 3,953,516 or any other anode assembly suited for use with an anode post in an electrolytic cell.

The anode assembly is suspended from the bus bar and supporting channel 11 by lower lead-in nut 27 and upper lead-in nut 28 both threaded on lead-in 16 and together locking the anode assembly to the bus bar and is adjusted by screws 17 and nuts 18. One or more apertures 50 are provided in spaced pattern in cell cover 19 and the anode lead-in and its surrounding anode post sleeve 24 pass through aperture 50 to support assembly 21. Aperture 50 is closed by means of a seal assembly 10, which comprises a seal 30, a disc 31, bolts 32 and a clamp 34. The seal 30 is sealed against post sleeve 24 and held within annular disc 31. Disc 31, at its lower edge, is held tightly against cell cover lining 33 which is turned through the aperture and lies against the top of the cell cover. Clamp 34 and bolts 32 maintain the seal 30 in position. Clamp 34 has U-shaped extensions **34*a* and can have a lower part 34*b* welded to the cell top. Alternatively, clamp 31 can be eliminated by use of screws or bolts passing through disc 31. Seal 30, together with disc 31, thus close the aperture through the cell cover 19 and prevent the escape of cell gas. Seal 30 is preferably a wet chlorine resistant "O" ring which provides dynamic sealing so as to allow vertical adjustment of the anode with respect to bottom 29 by adjusting nuts 18 and screws 17**.

Anodes 21 are suspended in the electrolyzer chamber of the mercury cell consisting of cell bottom 29 and side channels 35. The side channels 35 are lined with hard rubber coating 36. A strip of soft rubber 37 lies between rubber lining 36 and cell bottom 29 while another strip of soft rubber 38 lies between rubber coating 36 and lining 33 of cell cover 19.

Side channels 35 are held in place by bolts 39 and nuts 40 extending through the flanges of the channel and through the cell bottom. Side channels 35 are sealed to top 19 by means of C-clamps (not shown) spaced at suitable intervals along the side of the cell cover 19. The cell rests on transverse I-beams 41 and longitudinal I-beams 42.

Figure 2:
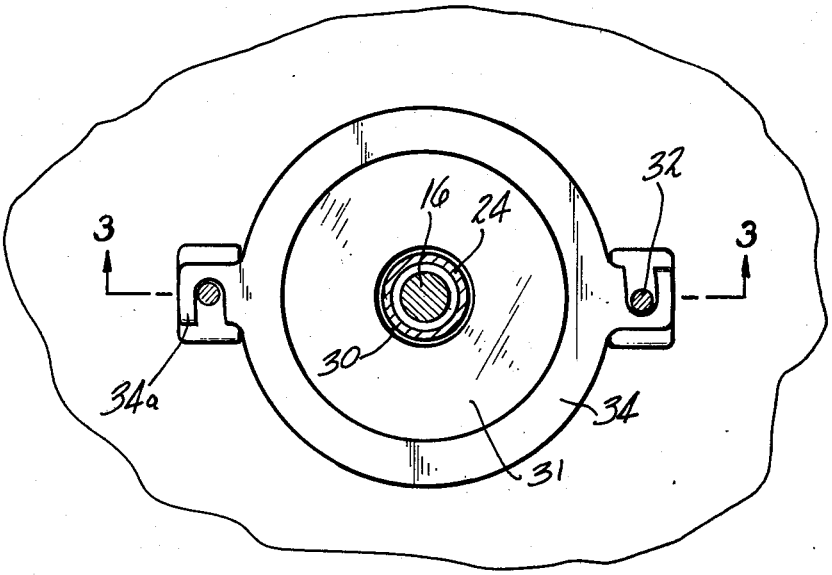
FIG. 2 is a top view of the preferred anode post seal assembly of the invention.
Figure 3:
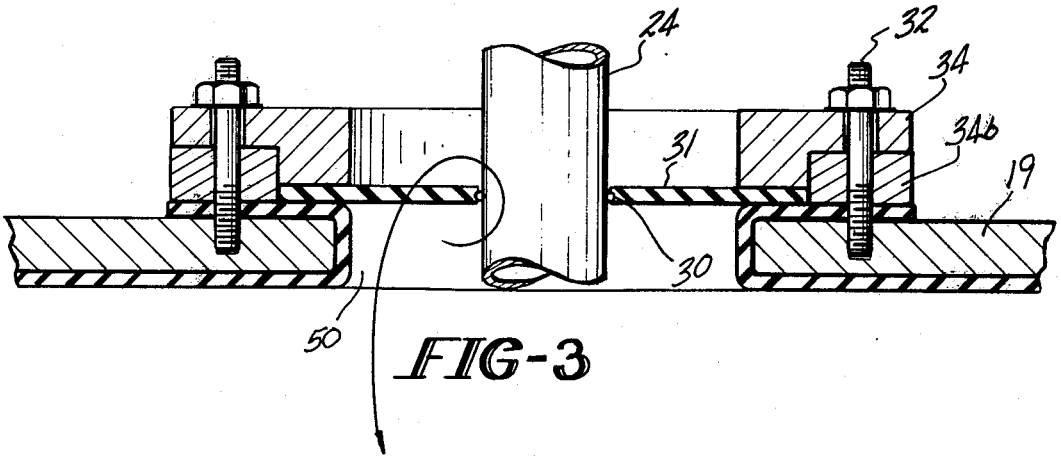
FIG. 3 is a section view along line 3—3 of FIG. 3.
Figure 4:
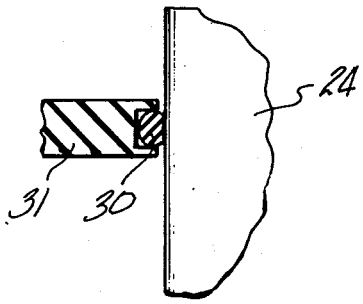
FIG. 4 is a close up of area 4—4 of FIG. 3.

FIGS. 2, 3 and 4 show seal assembly 10 in greater detail. Seal 30 can be made of any dynamic sealing wet chlorine resistant material such as neoprene or teflon. Disc 31 can also be made of any rigid wet chlorine resistant sealing material such as PVDC, neoprene or polytetrafluoroethylene. Clamp 34 can either be an unbroken ring or be split to facilitate attachment and replacement of seals and allows sufficient radial extension of disc 31 to avoid disc 31 falling through opening 50 in cell top 19.

After removing anode assembly 21, seal 30 and disc 31 can be easily replaced by simply loosening bolts 32 and removing clamp 34. A new seal is then inserted within a groove in a central opening of disc 31 and disc 31 can then be inserted within lower part **34*a* of clamp 34. Clamp 34 is then reinstalled and bolts 32 tightened. A lower clamp part 34*b* can be utilized to provide a recess to eliminate any unnecessary alignment problems when reinstalling clamp 34 or disc 31**.

FIGS. 3 and 4 show the reduction in the annular exposed area of seal 30 as compared with the annular area between the cell opening 50 and the outer surface of post sleeve 24. In practice, this reduction is about 99%, thus leaving only 1 percent as much flexible seal exposed. While disc 31 is also exposed, the fact that the disc need not flex, as in prior art devices such as the "boot 30" shown in U.S. Pat. No. 3,140,991 makes the disc more resistant to cracking.

Many changes will suggest themselves to those skilled in the art without departing from the invention. The following claims are intended and declared to cover all such equivalents.

EXAMPLE 1

An existing cell in a metal anode mercury cathode cell plant had 8 inch O.D./2 inch I.D. rubber cup type anode post sleeve seal to seal between a 2 inch O.D. anode post sleeve and a 6 inch I.D. opening in a cell top through which the anode is normally supported by an anode post within the sleeve. The cup seals were removed by first removing the anode post sleeve and then unbolting a ring clamp that held each such seal. A 2 × 3/16 inch neoprene "O" ring was inserted within a central groove of an 8 0.0 × 21/16 inch I.D. annular PVDC disc and the disc then mounted over the cell top opening in place of the removed cup seal. The 2 inch O.D. anode post sleeves were then passed through the "O" rings. The "O" rings together with the PVDC discs seldom leaked and a material cost savings in seals was realized. The specific dimensions are as indicated in the following table.

TABLE 1

| Reference No. | Item | Diameter (Inches) | Area (Sq. In.) |
|---|---|---|---|
| 50 | Cell Top Opening | 6 | 28 |
| 24 | Anode Post Sleeve O.D. | 2 | 3 |
| 31 | Annular Disc | 8,2.1 | 46.5 |
| 30 | "O" Ring (2" × 3/16") | 2 nom. | 0.7 |

TABLE 1-continued

| Reference No. | Item | Diameter (Inches) | Area (Sq. In.) |
|---|---|---|---|
| — | Disc to Anode Post | 2.1,2 | 0.3 |
| — | Cell top to Anode Post | 6,2 | 25 |

$$\frac{\text{Cell Top to Anode Post Area}}{\text{Disc to Anode Post Area}} = \frac{25}{0.3} = 83$$

What is claimed is:

1. A seal assembly for an electrolytic mercury cell having an adjustable anode post sleeve passing through an anode opening in a cell top lined with a wet chlorine resistant lining turned upwardly through said opening, comprising:

a. a rigid annular disc means, separate from said lining, of wet chlorine resistant material having an inner surface defining a grooved central opening conforming to the exterior of the anode post sleeve, for attachment to the cell top in sealing contact with said lining so as to occupy a major portion of the anode-to-cell top opening, said opening being of at least twice the diameter of said anode post;

b. connector means for attaching the disc to the cell top and pressing said disc into sealing contact with said lining; and c. annular wet chlorine resistant elastomeric seal means, adapted to be held within the groove of the central opening of the disc, for continuously sealing between the disc and the anode post sleeve both while the anode is moving and while the anode is stationery.

2. The apparatus of claim 1 wherein the disc is comprised of polyvinylchloride.

3. The apparatus of claim 2 wherein the seal means is a neoprene "O" ring.

4. The apparatus of claim 2 wherein the seal means is comprised of polytetrafluoroethylene.

5. The apparatus of claim 1 wherein the attachment means comprises a ring clamp.

6. The apparatus of claim 1 wherein the disc is attached to the cell top by a fastening member passing through the disc and into engagement with the cell top.

7. The apparatus of claim 1 wherein the radial cross-sectional area of the elastomeric seal means is less than one-fifth the radial cross-sectional area of the anode post.

8. The apparatus of claim 1 wherein the radial cross-sectional area of the annular space between the inner surface of the disc and the exterior surface of an anode past inserted through the disc opening is less than one-tenth of radial cross-sectional area of the annular portion of the cell top opening between the cell top and the exterior surface of an anode post inserted through the cell top opening.

9. An electrolytic cell, comprising:

a. a cell top having a lower interior surface, an upper exterior surface and a vertical surface defining an opening communicating said interior and exterior surfaces;

b. a lower housing portion connected to the cell top;

c. a vertically movable anode post passing through the cell top opening, said opening being at least twice the diameter of said anode post;

d. a wet chlorine resistant lining having portions covering said interior surface, said vertical surface and a region of said exterior surface adjacent said opening;

e. an annular wet chlorine resistant rigid disc means, separate from said lining, sealingly and rigidly clamped against the portion of said lining covering said region of said exterior surface adjacent said opening and attached to the cell top for projecting toward said post from said lining occupying a major portion of a space between the anode post and the surface defining the cell top opening; and f. an annular wet chlorine resistant seal means, held by the disc means, for occupying the remaining minor portion of the space between the anode post and the surface defining the cell top opening.

10. A method of replacing an annular cup-shaped anode post cell top flexible seal of an electrolytic mercury cell having a cell top with an electrolyte resistant lower lining turned upwardly through cell top openings, which comprises the steps of:

a. disattaching the cup-shaped seal from the cell top;

b. installing an elastomeric wet chlorine resistant annular seal, of much less cross-sectional area than the cross-sectional area of the cup-shaped seal, within a rigid wet chlorine resistant annular disc; and c. sealingly attaching the rigid disc to the cell top with the same attachment means previously used to attach the cup-shaped seal so as to force said disc sealingly against the upwardly turned portion of said lining.

11. The assembly of claim 1, wherein said disc means occupies about 99% of the cross-sectional area of the opening between the anode post sleeve and cell top and said seal means occupies the remaining about 1% of said area.

12. The cell of claim 9, wherein said disc means occupies about 99% of the cross-sectional area of the opening between the anode post sleeve and cell top and said seal means occupies the remaining about 1% of said area.

13. The method of claim 10, wherein said disc means occupies about 99% of the cross-sectional area of the opening between the anode post sleeve and cell top and said seal means occupies the remaining about 1% of said area.

* * * * *